US010066344B2

(12) United States Patent
de Vries

(10) Patent No.: US 10,066,344 B2
(45) Date of Patent: Sep. 4, 2018

(54) METHOD OF MAKING AN EQUESTRIAN SURFACE USING STONE FIBERS

(75) Inventor: Linda de Vries, Maasbracht (NL)

(73) Assignee: ROCKWOOL INTERNATIONAL A/S (DK)

( * ) Notice: Subject to any disclaimer, the term of this patent is extended or adjusted under 35 U.S.C. 154(b) by 0 days.

(21) Appl. No.: 14/004,761

(22) PCT Filed: Mar. 14, 2012

(86) PCT No.: PCT/EP2012/054488

§ 371 (c)(1),
(2), (4) Date: Nov. 6, 2013

(87) PCT Pub. No.: WO2012/123507

PCT Pub. Date: Sep. 20, 2012

(65) Prior Publication Data

US 2014/0056642 A1 Feb. 27, 2014

(30) Foreign Application Priority Data

Mar. 14, 2011 (EP) ..... 11158164

(51) Int. Cl.

| | |
|---|---|
| ***E01C 7/04*** | (2006.01) |
| ***E01C 13/06*** | (2006.01) |
| ***E01C 7/02*** | (2006.01) |
| ***E01C 21/00*** | (2006.01) |

(52) U.S. Cl.

CPC ..... *E01C 13/06* (2013.01); *E01C 7/02* (2013.01); *E01C 7/04* (2013.01); *E01C 21/00* (2013.01)

(58) Field of Classification Search

CPC ..... E01C 13/00; E01C 13/08; E01C 13/10; E01C 7/04; E01C 9/00; E01C 13/06; E01C 21/00

USPC ..... 404/27, 75, 71

See application file for complete search history.

(56) References Cited

U.S. PATENT DOCUMENTS

| | | | | |
|---|---|---|---|---|
| 4,433,813 | A | 2/1984 | Whatton et al. | |
| 4,819,933 | A | 4/1989 | Armond | |
| 5,020,936 | A * | 6/1991 | Malmgren et al. | 404/32 |
| 5,326,192 | A * | 7/1994 | Freed | 47/9 |
| 5,730,549 | A * | 3/1998 | Choudin et al. | 404/75 |
| 5,746,546 | A * | 5/1998 | Hubbs et al. | 405/263 |
| 8,366,561 | B2 * | 2/2013 | Moosdorf | E01C 13/02 428/17 |
| 2006/0278361 | A1 * | 12/2006 | Westerkamp | 162/348 |
| 2011/0146531 | A1 * | 6/2011 | Mitra | 106/18.26 |
| 2013/0221567 | A1 * | 8/2013 | Jorgensen et al. | 264/241 |
| 2013/0295813 | A1 * | 11/2013 | Hansen et al. | 442/327 |

FOREIGN PATENT DOCUMENTS

| | | |
|---|---|---|
| EP | 0136747 | 4/1985 |
| GB | 217471 | 6/1924 |
| NL | 9300602 | 11/1994 |
| NL | 1004801 | 6/1998 |
| WO | 9721876 | 6/1997 |

* cited by examiner

*Primary Examiner* — Gary S Hartmann

(74) *Attorney, Agent, or Firm* — Tarolli, Sundheim, Covell & Tummino LLP

(57) ABSTRACT

The invention provides a riding surface formed of a mixture of sand with stone fibers.

10 Claims, No Drawings

METHOD OF MAKING AN EQUESTRIAN SURFACE USING STONE FIBERS

FIELD OF THE INVENTION

The present invention relates to surfaces for equestrian uses comprising a mixture of stone fibres and sand, and to their use and methods for making them.

BACKGROUND OF THE INVENTION

It is well known to provide non-grassed surfaces for training and competition in equestrian sports. A wide variety of such surfaces have been suggested and used over the many years in which non-grassed surfaces have been in use for equestrian sports.

One known form of riding surface is based on finely chopped PVC (from used electrical cable insulation material). However, this surface also has the disadvantage of being rather loose and cost is rather high.

Another known surface is based on ashes from power stations. The surface provides good drainage when newly laid in wet weather, but in dry conditions the surface is dusty and becomes compacted and too hard, especially after prolonged use.

Another known surface, commonly known as hard porous, comprises a water bound grit/sand/clay mixture, normally laid over a drainage layer of coarser material. Such a surface has the disadvantage of inadequate cushioning and is excessively abrasive. The surface material also has a tendency to gradually lose its structure and permeability over time. In dry weather dust is a problem.

Other riding surfaces include synthetic materials intended to imitate real turf. Such synthetic turf may be in filled with a top dressing of sand. Such a surface is expensive to install, and expensive and difficult to maintain and repair.

It is well known to provide surfaces for horse riding based on sand or other particulate materials. The principal problem with sand as a surface is that it has a tendency to be too loose or too deep. Conversely, if the conditions are dry the riding surface can become too hard which leads to a risk of leg injuries to the horses. If sand is completely dry, however, the riding surface can become extremely loose, which leads to a risk of leg injuries to the horses.

U.S. Pat. No. 4,819,933 discloses a surface is for use in equestrian events formed of a blend of sand and fibres in which the fibres are polymeric fibres.

Other means for production of artificial riding surfaces are described in U.S. Pat. No. 4,433,813, which provides the surface from wood chips.

NL 1004801 describes a riding surface comprising plastic fibres.

NL 9300602 describes bonded webs of fibres which are generally organic.

EP-A-136747 describes an artificial grass field of which the substructure is based on sand. Thus, this structure is different from a standard sand-based riding surface, of which the sand forms the surface which is exposed and on which the horses are ridden. According to this publication, the substructure for the artificial field is a blend of sand and at least 1 wt/% fibrous material, which can be organic fibres or artificial fibres such as polypropylene fibres or nylon fibres. Inorganic fibres such as glass fibres are also mentioned. These surfaces are described as useful for football, hockey, tennis and for riding schools.

Another document concerning substructures for artificial sports surfaces is WO 97/21876 in which sand or other granular material is blended with fibres. These can be mineral fibres such as glass fibres.

GB 217471 A relates to a material for the construction of tennis courts and the like, which consists of a gritty material, such as ground brick, and asbestos (which is a type of natural crystalline silicate fibre). In contrast with stone fibres (which are a class of man-made vitreous fibre), the use of asbestos can give rise to health concerns.

SUMMARY OF THE INVENTION

According to the invention, we provide a surface, suitable for equestrian use, formed of a mixture of sand with stone fibres.

We find that the incorporation of stone fibres into the sand has numerous advantages. A relatively small percentage by weight of stone fibres results in a significant improvement in the consistency of the sand surface. It provides a surface which is more cohesive and less "deep" or "loose" in comparison with sand alone. Stone fibres have an advantage of being sustainable to produce and so have environmental advantages over, for instance, polymeric fibres. At the same time they exhibit minimal deterioration with age and therefore replacement costs are extremely low, especially compared with, for instance, cellulosic materials such as coco fibres. Stone fibres have the further advantage over, for instance, cellulosic and other hydrophilic fibres, that they do not absorb moisture which results in elimination of the risk of fungal growth. It is also found that other synthetic fibres have a tendency to lose their effectiveness over time so that the surface becomes rather loose. Stone fibres not exhibit this disadvantage.

It has also been found that the inclusion of stone fibres in the surface allows the energy restitution of the surface to be sufficiently high, even when there is a high moisture content in the surface. High moisture content usually has a negative impact on the energy restitution of a sand surface. Tolerance of a relatively high level of moisture allows the stability of the surface to be improved without diminishing other properties to unacceptable levels.

Thus, by the use of stone fibres according to the invention, we provide a cohesive surface which retains its cohesion over a significant period of time, hence providing a surface having good riding properties, in both wet and dry conditions, without major cost or environmental impact and without risk of fungal growth in the surface.

According to the invention we also provide a method of modifying a riding surface formed of sand by blending stone fibres with the sand. The invention also provides the use of stone fibres to improve the cohesivity of a riding surface formed of sand.

DETAILED DESCRIPTION OF THE INVENTION

The fibres used in the invention are stone fibres. Thus, generally the fibres are man-made vitreous fibres which have content of alkaline earth metals (calcium oxide and magnesium oxide) from 10 to 40 wt/%. They also contain the other usual oxide constituents of mineral wool. These are silica; alumina; alkali metals (sodium oxide and potassium oxide) which are usually present in lower amounts; and can also include iron oxide, titania and other minor oxides. In some cases the stone fibres can have a content of iron oxide at least 3 wt/% (calculated as $Fe_2O_3$).

In general, the stone fibres preferably have content of oxides as follows:

| | |
|---|---|
| $SiO_2$ | 35 to 50, preferably 38 to 48 |
| $Al_2O_3$ | 12 to 30, preferably 15 to 28 |
| $TiO_2$ | up to 2 |
| $Fe_2O_3$ | 2 to 12 |
| CaO | 5 to 30, preferably 5 to 18 |
| MgO | up to 15, preferably 1 to 8 |
| $Na_2O$ | 0 to 15 |
| $K_2O$ | 0 to 15 |
| $P_2O_5$ | up to 3 |
| MnO | up to 3 |
| $B_2O_3$ | up to 3 |

These values are all quoted as wt % oxides, as is conventional.

The fibres can preferably have good bio-solubility at pH 4.5. This bio-solubility can be determined by known means, for instance in vitro in terms of a dissolution rate at acid pH (about pH 4.5) of at least 25 nm/day. Alternatively the bio-solubility may be determined in vivo in known manner.

Surprisingly, we find that despite the fact that preferred fibres are bio-soluble, they maintain their effectiveness at maintaining a cohesive riding surface for a considerable period of time in use.

These fibres are particularly suitable for surfaces for inside use.

The fibres preferably have length at least 2000 microns, preferably at least 2500 microns, more preferably at least 3000 microns. The length can be determined by any method known in the art of man made vitreous fibres, using standards to normalise the results. One example is a method in which the length of the fibres is measured automatically using a microscope, with a camera and image analysing software. First, a well dispersed sample is prepared on a Petri dish. The sample is heat cleaned at 590° C. for 10 minutes. 0.4 g of the heat cleaned fibres are dispersed, by the use of ultrasound, in 36 ml of dispersing solution (ethyleneglycol 49.5% vol, water 49.5% vol and 1% non foaming dispersing aid). 0.7 ml of this dispersion is again diluted in 36 ml dispersing solution. 0.7 ml of this dispersion is applied on a Petri dish and divided thoroughly on the surface A microscope with a magnification of 1.25×1 is used to view the fibres and their length is measured. From these measurements, the numeric average length can be calculated. For the reproducibility of results, the number of measurements should be higher than 500.

We find that fibres having lengths above these minima also tend to give best results in terms of cohesivity in the riding surface. Length at least 3500 microns can be particularly effective.

Preferably the fibres have length not more than 5000 microns, more preferably not more than 4500 microns.

The diameter of the fibres is generally in the range 3 to 15 microns, preferably in the range 6 to 12 microns. Fibre diameter can be determined by any method known in the art of mineral fibres, using standards to normalise the results. One example is a method in which the diameter of the fibres is measured automatically using a microscope, with a camera and image analysing software. A sample is heat cleaned at 590° C. for 10 minutes. Then the sample is pressed to obtain a length of approximately 30 microns. 0.05 g of the pressed fibers is dispersed, by the use of ultrasound, in 36 ml dispersing solution (ethyleneglycol 49.5% vol, water 49.5% vol and 1% non foaming dispersing aid). 0.05 ml of this dispersion is applied on a Petri dish and thoroughly divided on the surface. A microscope with a magnification of 1.25× 10 is used to view the fibres and measure their diameters. From these measurements, the numeric average diameter and mass weighted average diameter can be calculated. For the reproducibility of results, the number of measurements should be between 1000 and 1200.

Values for fibre dimensions in this description are expressed as numeric averages.

The fibres preferably have hardness of around 6 Moh.

The melting point of the fibres is preferably more than 1000° C.

The specific density of the fibres is generally in the range 2 to 3.5 g/cm$^3$, preferably 2.5 to 3.0 g/cm$^3$.

Preferably the fibres are in the form of a granulate, which comprises flocks of entangled fibres. The granulate can be produced by pouring mineral melt onto spinning wheels, the melt being thrown off the wheels in the form of fibres and non-fiberised shot. The fibres are of sufficient length to become entangled with one another to form flocks. They are carried from the spinning wheels in an air-flow and collected as bales.

The fibres can be coated with various additional components (wetting agent, for example), but preferably the stone fibres that are mixed with the sand to form the surface consists essentially of vitreous material.

The fibre product used preferably has a relatively low level of non-fiberised materials (commonly known as shot). Accordingly, the amount of shot (particles of size more than 63 microns which are non-fiberised) in the bulk fibres mixed with the sand is preferably not more than 40 wt/%, preferably not more than 35 wt/%. Preferably the amount of non-fiberised material having size above 250 microns is not more than 15 wt/%, preferably not more than 10 wt/%. Preferably the proportion of non-fiberised material having size about 600 microns is not more than 3 wt/%, preferably not more than 1.5 wt/%.

According to the invention, in the surface used the fibres are blended with sand. Stone fibres are effective at improving the cohesivity and riding properties of a sand surface even at relatively low levels. The proportion of stone fibres, based on total weight of sand is preferably at least 0.1 wt/%, preferably at least 0.2 wt/%, more preferably at least 0.3 wt/% and even more preferably at least 0.5%. Even more preferably, the proportion of fibres, based on the total weight of sand is at least 1% wt/% or at least 2% wt/%. Most preferably the proportion of fibres, based on the total weight of sand is at least 3 wt/%.

The proportion of stone fibres is preferably not more than 30 wt/%, more preferably not more than 20 wt/%, more preferably not more than 15 wt/%, especially not more than 10 wt/%, and the invention can be effective even when the amount of stone fibres is not more than 0.8 wt/%.

Preferably the stone fibres are the only fibres incorporated into the sand surface. In particular, the stone fibres constitute the only solid additive blended with the sand.

The sand/stone fibre blend is generally spread on top of a soil or a prepared drainage base, as is conventional for sand-based riding surfaces.

The surface can be made by providing a pre-formed blend of sand and stone fibres and then distributing that over a soil or prepared drainage base. However, preferably the sand is distributed over the surface first and then the stone fibres are blended with the sand. Mixing to provide the surface can be carried out in any convenient manner which leads to a blended surface, for instance using agricultural techniques. For instance agricultural implements such as forks can be used. For instance the stone fibres may be distributed over the sand and then blended with the use of a tractor.

During the method the sand is preferably slightly moist so as to improve dispersibility of the fibres throughout the blend.

In order to maintain a homogeneous mix of sand and fibres when the surface is used, it can be advantageous to compact the sand to some extent either before the fibres are added or when they are present.

Alternatively, the compacting effect can occur during use. However, if the surface is not compacted before use, it can be advantageous to add additional fibres after a period of use. For example, further fibres can be added after the equivalent of at least 1, 2, 3 or 5 months of daily use for approximately 5 hours. Following this level of use, the surface is generally sufficiently dense to prevent a large amount of separation of the sand and the fibres into layers. Usually, the proportion of the fibres, based on total weight of fibres, that is added after a period of use, is from 10 wt/% to 90 wt/%, preferably from 20 wt/% to 80 wt/%, more preferably from 30 wt/% to 70 wt/%.

Following the addition of the further fibres, the proportion of fibres, based on the total weight of sand is preferably at least 0.5 wt/% and more preferably at least 1 wt/%, although an improved riding surface is still obtained with lower quantities of fibres such as less than 0.8 wt/%.

According to the invention the surface is generally an exposed surface so that there is no additional layer above the blend of sand and stone fibres. Thus, the horses are ridden directly on the sand/stone fibre surface so that their hooves are in contact with the blend of sand and stone fires.

The depth of the blend of sand and stone fibres forming the riding surface is preferably in the range 10 to 20 cm.

The sand base preferably has a bulk density in the range 1400 to 1800 kg/m$^3$, often in the range 1500 to 1700 kg/m$^3$.

The fibres can be made by any known means for producing stone fibres. That is, they can be made by providing solid mineral raw materials, melting these raw materials to form a melt and forming the melt into fibres, and collecting the fibres.

Example

In this example, two types of stone fibres, A and B, are used, as follows: Fibres A are commercially available fibres sold under the name Lapinus 702 K2-Roxul 1000. Fibres B are commercially available fibres sold under the name Lapinus 706 K2 Roxul 1000. Fibres A have length approximately 4000 microns. Fibres A have flock size large. Fibres B have length approximately 3000 microns and a medium flock size. For both fibres A and B, the proportion of shot above 63 microns in the product is 33.1 wt/%; the proportion of shot about 250 microns is 7.7 wt/%; the proportion of shot above 600 microns is 0.7 wt/%. The fibre diameter was approximately 9 microns in both cases. Both fibres have hardness 6 Moh, melting point about 1000° C. and specific density 2.75 g/cm$^3$.

A sand layer of thickness 15 cm was distributed over a riding area 20 m×40 m, namely 800 m$^2$ surface area. The density of the sand was 1600 kg/m$^3$ and the total volume of sand used was 120 m$^3$ with the total mass of sand being 192000 kg.

The sand was humidified with water so as to increase the dispersibilty of the fibres and fibre flocks in a homogenous manner. 960 kg fibres A are distributed over the surface using a pitchfork. The fibres are then further worked into the sand with a Zetor 5213 tractor and agricultural equipment which contains an open roller and two turning heads with in rod rotation wheels. The depth of the turning heads can be varied between approximately 3 cm and 10 to 15 cm into the sand layer. The top layer was worked until the fibres and fibre flocks were visually dispersed homogeneously.

Following five months of daily use (approximately 5 hours per day), a further 960 kg of fibres A were distributed on the surface and riding of horses over the surface was used to distribute these into the surface.

The same method can be used with fibres B.

The surface was used for riding of horses over a period of months. The surface was reported to give a less deep and less loose surface than sand and to retain this cohesivity over the months of use.

The invention claimed is:

1. A method of making an equestrian surface comprising providing a layer of sand and blending stone fibres into the sand, wherein the proportion of fibres, based on weight of sand, is at least 0.2 weight % and no more than 20 weight %;

wherein the fibres have length at least 2000 microns to 5000 microns and are in the form of a granulate comprising flocks of entangled fibres.

2. A method according to claim 1 in which the stone fibers have content of oxides, as weight %, as follows:

| | |
|---|---|
| $SiO_2$ | 38 to 48; |
| $Al_2O_3$ | 15 to 28; |
| CaO | 5 to 18; and |
| MgO | 1 to 8. |

3. A method according to claim 1 in which the fibres have length at least 2500 microns to 5000 microns.

4. A method according to claim 1 in which the diameter of the fibres is in the range 3 to 15 microns.

5. The method of claim 1 wherein the stone fibres in the form of said granulate comprising flocks of entangled fibres are distributed over the layer of sand and then blended by use of a tractor.

6. The method of claim 5 wherein, during the blending, the sand is moist.

7. The method of claim 5 further comprising the step of compacting the sand before or after the stone fibres are distributed.

8. The method of claim 1 further comprising the step of mixing the stone fibres with the sand with an amount of shot having a size of about 600 microns and not more than 1.5 wt/%.

9. The method of claim 1 wherein the stone fibres are the only fibres incorporated into the surface.

10. A method of modifying a riding surface formed of sand by blending stone fibres with the sand;

wherein the proportion of fibres, based on weight of sand, is at least 0.2 weight % and not more than 20 weight %;

wherein the fibres have length at least 2000 microns to 5000 microns and are in the form of a granulate comprising flocks of entangled fibres;

whereby the cohesivity of the riding surface is improved by modifying the riding surface;

wherein the fibres are bio-soluble and have a dissolution rate at pH about 4.5 of at least 25 nm per day.

* * * * *